US007600936B2

(12) United States Patent
Landow

(10) Patent No.: US 7,600,936 B2
(45) Date of Patent: Oct. 13, 2009

(54) DUAL DISPENSER PEN

(75) Inventor: Brian Landow, Hauppage, NY (US)

(73) Assignee: Lanco Corporation, Hauppage, NY (US)

( * ) Notice: Subject to any disclaimer, the term of this patent is extended or adjusted under 35 U.S.C. 154(b) by 33 days.

(21) Appl. No.: 11/939,795

(22) Filed: Nov. 14, 2007

(65) Prior Publication Data

US 2009/0123212 A1 May 14, 2009

(51) Int. Cl.
*B05C 1/00* (2006.01)

(52) U.S. Cl. ..... 401/19; 401/17

(58) Field of Classification Search ..... 401/16, 401/17, 19, 27, 75, 175, 98
See application file for complete search history.

(56) References Cited

U.S. PATENT DOCUMENTS

| | | | | |
|---|---|---|---|---|
| 1,749,565 | A | 3/1930 | Coryell | |
| 2,178,997 | A | 11/1939 | Mitchell | |
| 4,244,525 | A | 1/1981 | Manna | |
| 5,492,248 | A | 2/1996 | Ortner | |
| D422,748 | S | 4/2000 | Lang | |
| D429,847 | S | 8/2000 | Lang | |
| 6,152,634 | A * | 11/2000 | Kim | 401/195 |
| 6,241,408 | B1 | 6/2001 | Lang | |
| 6,340,258 | B2 * | 1/2002 | Gueret | 401/87 |
| 6,450,179 | B2 | 9/2002 | Bengis | |
| 6,607,323 | B2 | 8/2003 | Breidenbach et al. | |
| 6,926,166 | B1 | 8/2005 | Bitton et al. | |
| 6,981,811 | B2 | 1/2006 | Breidenbach et al. | |
| 7,168,875 | B1 | 1/2007 | Zhang et al. | |
| 7,377,709 | B2 * | 5/2008 | Butler | 401/195 |
| 2005/0191110 | A1 | 9/2005 | Bitton | |
| 2006/0013640 | A1 | 1/2006 | Skakoon et al. | |

* cited by examiner

*Primary Examiner*—David J Walczak
(74) *Attorney, Agent, or Firm*—Shoemaker and Mattare

(57) ABSTRACT

A dual dispenser for personal products such as cosmetics has two dispensers, one at either end of a tubular body. A wall divides the barrel into two chambers, which are filled with the respective products. One of the dispensers may be a sprayer and the other may be a lipstick-type dispenser, so that products of different types can be conveniently carried in a single pen-shaped article.

9 Claims, 3 Drawing Sheets

DUAL DISPENSER PEN

BACKGROUND OF THE INVENTION

This invention relates to a dual dispenser pen for products such as cosmetics.

Different types of cosmetics dispensers are well known, including liquid sprayers, lipstick dispensers and the like. Many people carry a substantial number of different dispensable products, each in its own container. It would be more convenient for them to have to carry fewer articles, without giving up the number of products on hand.

SUMMARY OF THE INVENTION

An object of the invention is to provide a product which can be used to contain two different products—especially products of different types, such as lip balm and a sun-blocking liquid—and to dispense the products in a way appropriate to each.

Another object is to provide a two-product dispenser having substantially a cylindrical pen-like shape, and adapted to dispense alternative products from either end.

These and other objects are attained by a dual dispenser pen as described and claimed below.

BRIEF DESCRIPTION OF THE DRAWINGS

In the accompanying drawings.

DESCRIPTION OF THE PREFERRED EMBODIMENT

Figure 1:
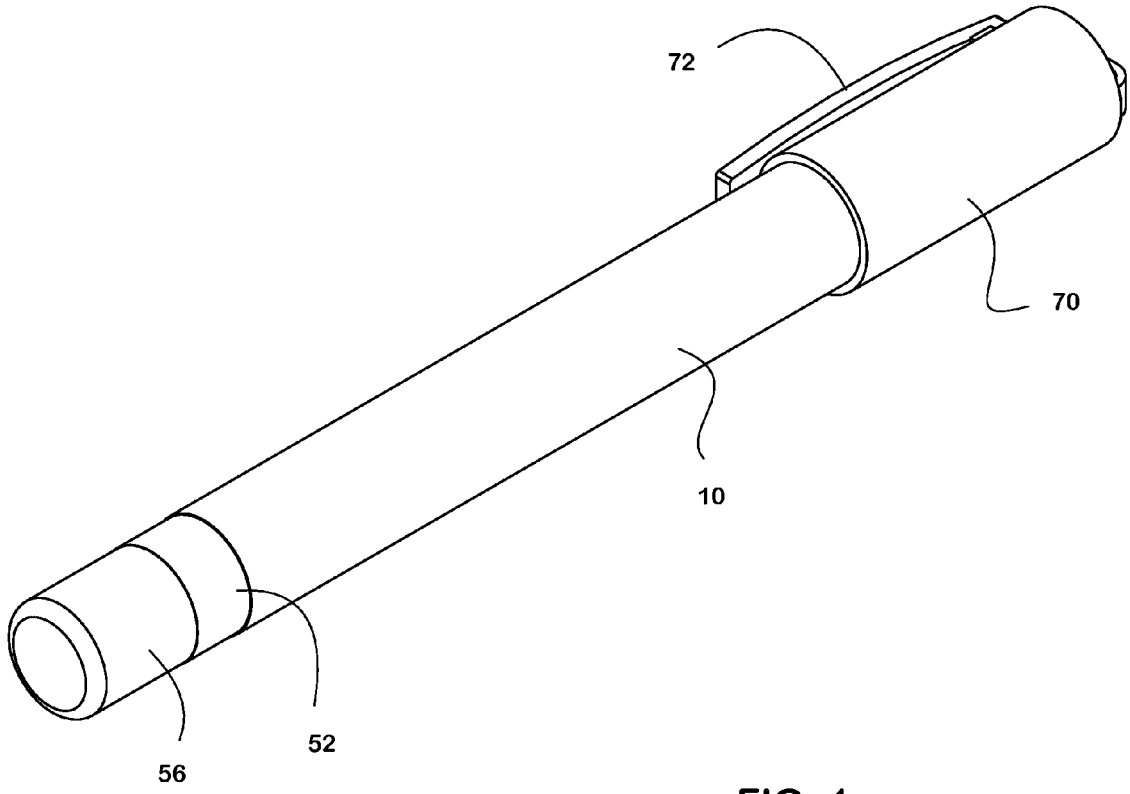
FIG. 1 is a perspective view of a dual dispenser pen embodying the invention.
Figure 2:
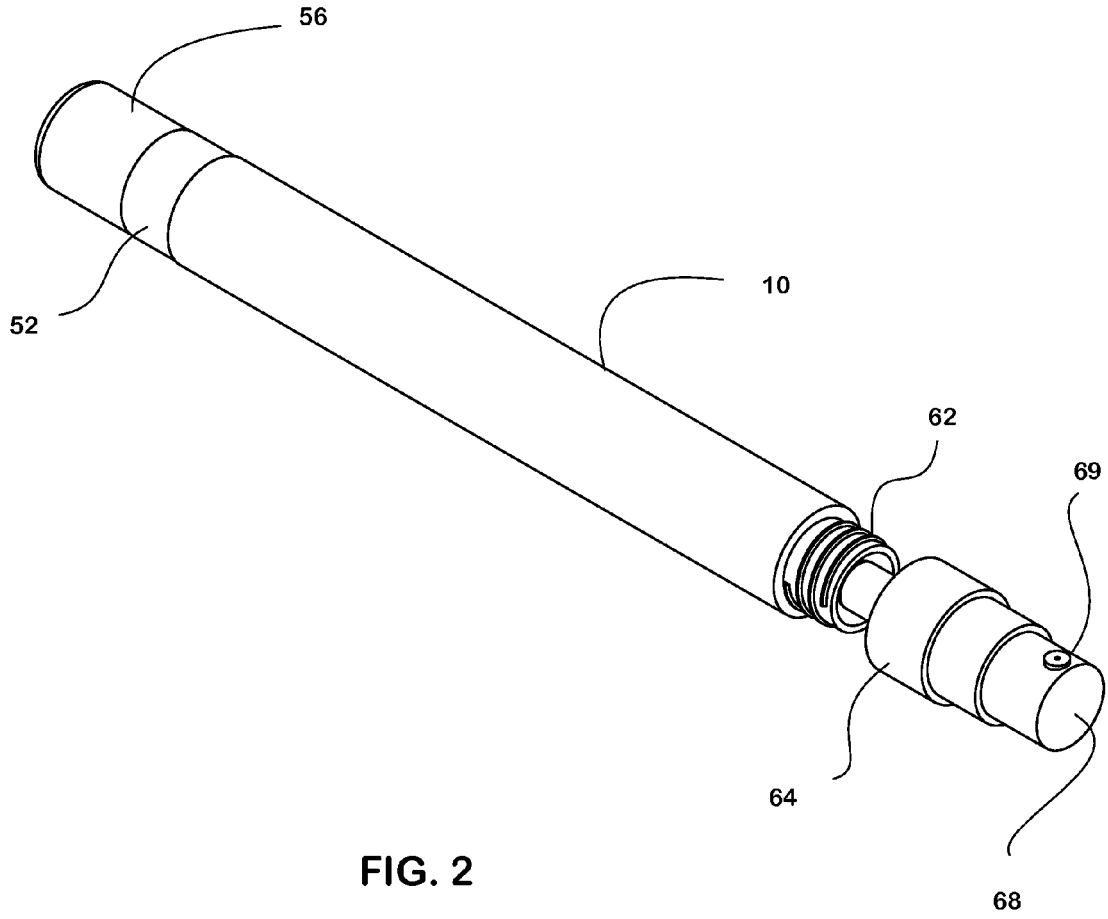
FIG. 2 is an exploded perspective view thereof.

A dual dispenser pen embodying the invention comprises a barrel 10 (FIGS. 1 and 2) which is divided into two open-ended chambers 12, 14 (FIG. 3) by a septum or wall 16 situated between the two ends 18, 20 of the barrel. In the example shown in the drawings, the wall is closer to the end 18 than to the end 20, but the wall could moved to another position if desired. A short tab 22 (FIG. 4) extends from its center of the septum into the chamber 12, for a purpose described below.

A first dispenser for a first fluent product is installed in the shorter chamber 12. The word "fluent", as used below, means a material capable of flowing, such as, but not limited to, a liquid, gel, wax or powder.

Figure 3:
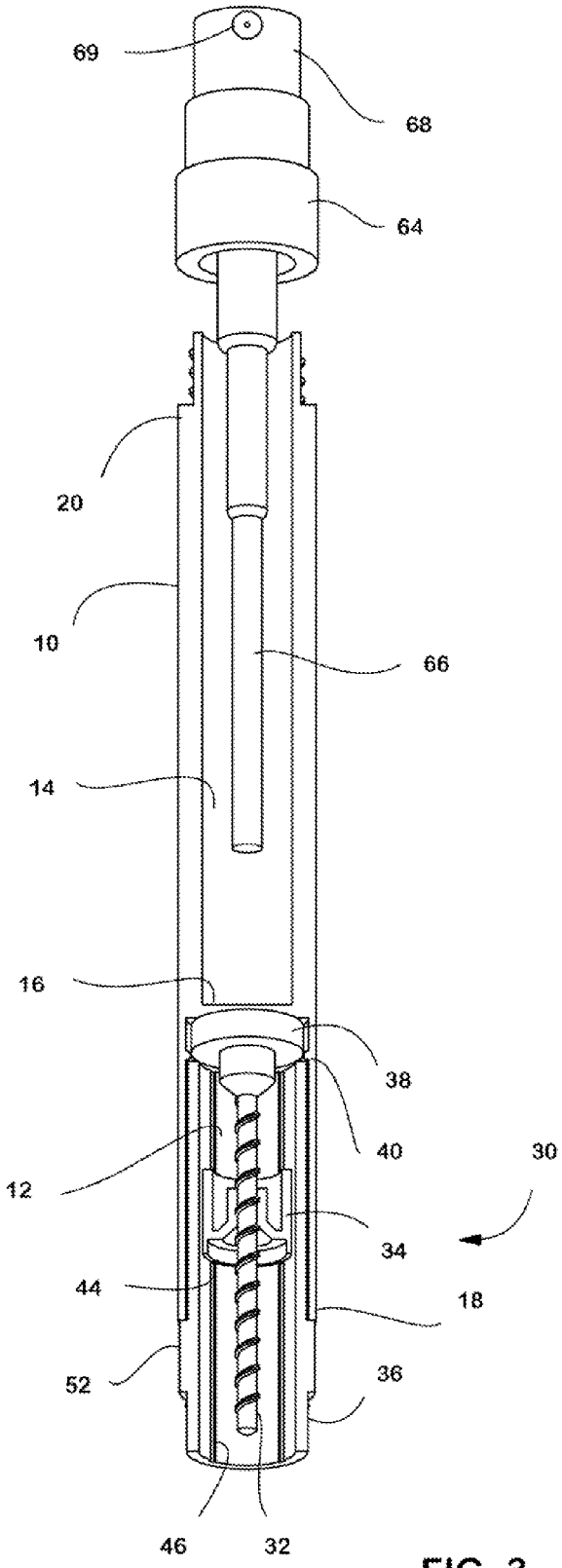
FIG. 3 is a sectional view showing details of a screw-type product dispenser contained within the dispenser pen.
Figure 4:
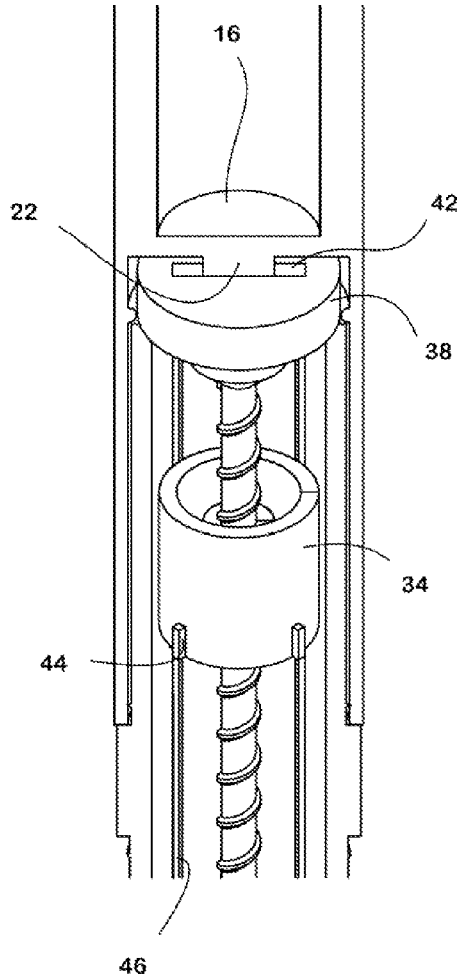
FIG. 4 is another sectional view from a different angle, showing certain components of the device at a greater scale.

As shown in FIGS. 3 and 4, the first dispenser 30 includes a plastic screw 32, a piston 34 mounted on the screw, and a rotatable sleeve 36 containing the piston. The screw is pressed, head 38 first, into the barrel until the head snaps behind a circumferential rib 40 formed on the inside of the barrel near the septum. The head has a slot 42 which receives the tab 22 extending from the septum. This positively prevents rotation of the screw. The piston has internal threads (not shown) which mate with the external threads on the shaft of the screw. The piston is slidable within the sleeve 36, but is prevented from rotating with respect to the sleeve by vanes 44 on the outside of the piston, which slide in axial grooves 46 on the inside surface of the sleeve.

The sleeve 36 is retained in the barrel by a first circumferential external rib (see FIG. 4) on the sleeve, which snaps into a complementary circumferential groove on the inside surface of the barrel. The rib and groove keep the sleeve within the barrel, but allow the sleeve to rotate with respect to the barrel. Just outboard of the first rib, the sleeve has a broad integral collar 52, having about the same outside diameter as the barrel. This provides a surface which can be grasped to turn the sleeve and thus the piston. Since the screw cannot turn, the piston—which rotates with the sleeve—moves up or down in the sleeve as the sleeve is turned.

The mouth of the sleeve outboard of the collar is sized to receive a cap 56 (see FIG. 1) which may be easily pushed on or pulled off the mouth. A second external circumferential bead (FIG. 4) around the mouth provides a fluid seal against the cap, and small projections (not shown) on the inside of the cap engage behind the bead 58 when the cap is installed.

During manufacture, the piston is initially placed at the bottom of the chamber, and a mass of fluent material such as lip balm (not shown) is inserted into the sleeve over the screw. The mass can be advanced as it is used up by turning the collar while holding the barrel.

The other chamber 14, in the illustrated example, is adapted to contain a liquid such as cologne, breath spray, glitter or water. Its reduced-diameter end has external threads 62 for retaining a second product dispenser, preferably a spray pump. The internally threaded body 64 of the spray pump assembly is screwed onto the threaded mouth. The pump assembly includes a downtube 66 which extends nearly to the wall 16 defining the bottom of the chamber 14, and is connected at its upper end to a pump within the body of the device. Internal details of the pump mechanism are not shown, inasmuch as such devices are well known and commercially available. The selection and/or design of a suitable pump is a matter of ordinary skill.

At the other end of the applicator there is a dispensing button 68 having a nozzle 69 in communication with the pump. Depressing the button causes the pump to deliver liquid from the chamber 14 to the nozzle. A spring (not shown) returns the button to its upward position.

The chamber 14 may be filled with a liquid such as sun block during manufacture, or it may be left empty so that the purchaser can fill the chamber 14 with a product of his/her choice.

The barrel has generally the shape of a large pen, and most preferably, a removable pen top 70 (FIG. 1) having an external pocket clip 72 is pushed over one end of the device.

It is contemplated that the products in the two chambers will be complementary, e.g., two products for application to the face, but the invention in its broadest sense is not limited to any particular products and other uses such as for food products may also be found useful.

Preferably, all the components described above, except for the return spring, are made of moldable plastics such a polyethylene, polypropylene or a polycarbonate. Most preferably, the barrel is transparent or translucent, for aesthetic reasons. However, the components could be made or metal or other materials, without departing from the scope of this invention.

The drawings illustrate the best mode of the invention presently known; however, the invention may be modified to suit particular needs. For example, the size, proportions and shapes of the various parts may be changes without departing from the inventive concept.

Since the invention is subject to modifications and variations, it is intended that the foregoing description and the accompanying drawings shall be interpreted as only illustrative of the invention defined by the following claims.

I claim:

1. A dual dispenser pen for dispensing two alternative products, said dispenser pen comprising a barrel having two open ends, a septum dividing the interior of the barrel into first and second chambers, a first product dispenser disposed at least partially within the first chamber, and a second product dispenser disposed at least partially within the second chamber, wherein one of the product dispenser is a screw-type dispenser comprising a sleeve having an open mouth, a piston within the sleeve adapted to push product out of the sleeve, the piston and sleeve having interacting structure which allow the piston to move axially within the sleeve, while preventing relative rotation between the piston and the sleeve, and a screw fixed within the barrel and having threads engaging corresponding threads in the piston to move the piston axially as the sleeve is turned with respect to the barrel, and further comprising a tab extending from the septum into a slot formed in the head of the screw to prevent the screw from rotating with respect to the barrel.

2. The invention of claim 1, wherein the first and second product dispensers are of different designs.

3. The invention of claim 1, wherein one of the product dispensers is a spraying dispenser.

4. The invention of claim 3, wherein the spraying dispenser comprises a body adapted to be connected to one end of the barrel, a downtube which extends from the body into one of said chambers of the barrel, a pump for pumping fluent material from the chamber via the downtube, and a manual actuator adapted to operate the pump, the manual actuator comprising a nozzle in fluid communication with the pump.

5. The invention of claim 4, wherein the manual actuator is a depressable button.

6. The invention of claim 1, further comprising a cap installable over the open mouth of the sleeve.

7. The invention of claim 6, wherein the mouth of the sleeve has an external circumferential bead and the cap has projections which engage the bead to retain the cap on the sleeve.

8. The invention of claim 1, further comprising a pen cover into which the barrel can be inserted, said pen cover having an external pocket clip.

9. The invention of claim 1, wherein the barrel is transparent or translucent.

* * * * *